United States Patent [19]

Wilson

[11] Patent Number: 4,951,342

[45] Date of Patent: Aug. 28, 1990

[54] STREET SWEEPING DRAG SHOE

[76] Inventor: Duffy Wilson, 58 Pride St., Westbrook, Me. 04092

[21] Appl. No.: 321,916

[22] Filed: Mar. 13, 1989

[51] Int. Cl.[5] ..... E01H 1/04

[52] U.S. Cl. ..... 15/246; 15/83

[58] Field of Search ..... 150/83, 84, 246, 346

[56] References Cited

U.S. PATENT DOCUMENTS

| | | | |
|---|---|---|---|
| 3,997,934 | 12/1976 | Toews | 15/246 |
| 4,144,610 | 3/1979 | Moore et al. | 15/159 A |
| 4,450,601 | 5/1984 | Schwayder | 15/246 |
| 4,489,458 | 12/1984 | Schwayder | 15/246 |
| 4,872,233 | 10/1989 | Brown | 15/246 X |

*Primary Examiner*—Chris K. Moore

*Attorney, Agent, or Firm*—Thomas L. Bohan

[57] ABSTRACT

A street sweeper drag shoe formed of an essentially planar, elongated strip of an elastomeric material. Such material being of sufficient hardness and resiliency that no reinforcing strips are required for the drag shoe to retain its shape. Especially, the drag shoe can be manufactured of polyurethane having a horizontal platform directed toward the inside of the drag shoe to help a cylindrical sweeper brush or other sweeper mechanism to move collected road debris up into the sweeper vehicle's hopper.

8 Claims, 1 Drawing Sheet

STREET SWEEPING DRAG SHOE

BACKGROUND OF THE INVENTION

This invention generally relates to the field of wiping blades. Particularly it relates to the field of drag shoes for street sweepers, by which is meant street cleaning machinery utilizing debris-removal techniques including but not limited to rotating brushes, vacuum, and regenerative air systems, respectively. Nevertheless, for definitiveness, the following discussion will be directed to street sweepers utilizing the brush mechanism.

Street sweepers generally comprise a tractor-like vehicle, rotating brushes, a means to transport swept-up debris from the street and a hopper into which the debris is tranported. One of the major functions of the rotating brushes is to sweep road debris forward, up off of the road surface and onto or into the transporation/-removal system. If the outside ends of this forward sweeping brush are not contained at road level, a significant amount of the road debris can escape laterally. Therefore, drag shoes are used to contain such debris. Drag shoes are positioned such that their length dimension is parallel to the axis of travel of the sweeper machine and therefore perpendicular to the sweeper brush. Also their height is much greater than their width. As their name suggests, these shoes then drag on the road surface, and in this manner, they keep the road debris from escaping laterally from the sweeper brush.

Traditionally, these drag shoes have been made in a number of ways. First, drage shoes of a soft rubber have been used. These have required the use of metal stiffeners to give the shoes the necessary longitudinal stiffness. However, if these drag shoes are deformed by contact with, e.g., curbs, grates, or railroad tracks, the deformations are made permanent by the concurrent deformation of the metal stiffener. Also, the use of soft rubber results in a short life span for the drag shoe as the rubber is quickly abraded by contact with the road surface. Second, drag shoes of steel have been used. In many cases, these drag shoes have included a hard, wear-resistant material e.g., U.S. Pat. No. 4,450,601 to Schwayder. Again, deformations of these drag shoes are permanent due to the use of at least one strip of metal along the length of the shoe. Also, the use of steel along the bottom of the shoe results in the creation of sparks as the shoe is dragged along the road surface.

Therefore, what is needed is a drag shoe which is resilient, which will not be subject to permanent deformations, which is stiff enough so it does no need any metal or non-resilient stiffeners, and which is sufficiently abrasion-resistant to provide for a long working life.

SUMMARY OF THE INVENTION

This invention is directed toward the use of a drag shoe in a street sweeper, which drag shoe is an essentially planar piece of an elastomeric material having a top and a bottom, with a length dimension much greater than its height dimension, which in turn is greater than the thickness dimension. The elastomeric material of said drag show preferably has a hardness ranging from about 80 to 90 as determined by the Shore A durometer test. Additionally, the drag shoe is preferably of polyurethane and may have attached above it a second, essentially horizontal strip which has a height dimension much greater than the thickness dimension. It is also contemplated that said drag shoe preferably includes a horizontal platform which extends toward the interior of said sweeper vehicle, and horizontal platform uniformly engages bristles of a cylindrical rotating brush which is also attached to said sweeper vehicle. Finally, said drag shoe may incorporate spacers to separate the main body of the drag shoe from a means for attaching said drag shoe to said sweeper vehicle.

DETAILED DESCRIPTION OF THE PREFERRED EMBODIMENT

Figure 1:
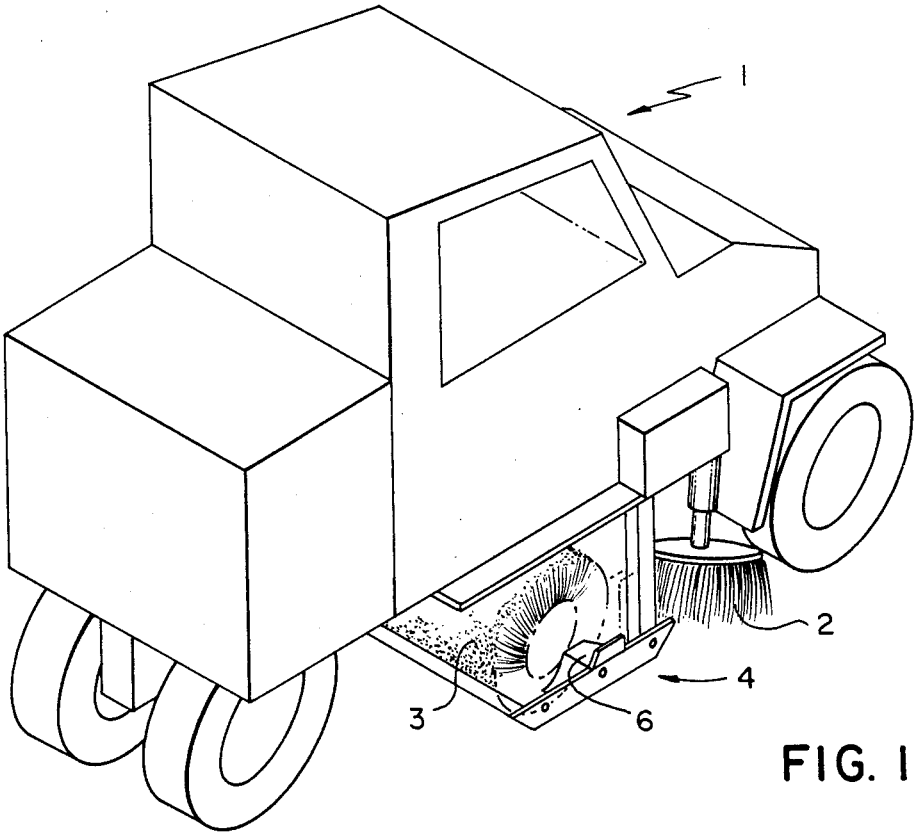
FIG. 1 is a drawing of a street sweeper showing various brushes and the drag shoe.
Figure 2:
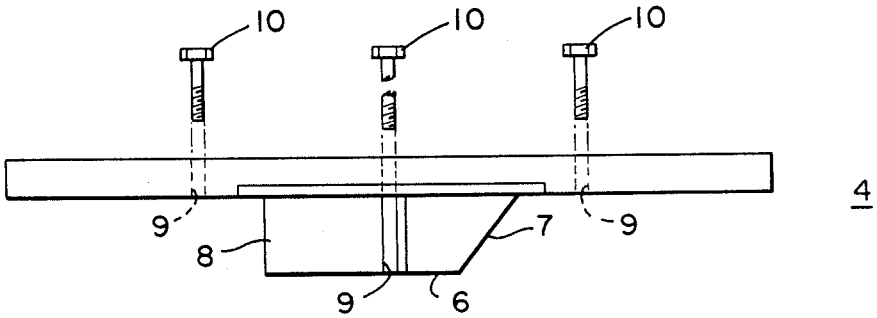
FIG. 2 is a top view of the drag shoe.
Figure 3:
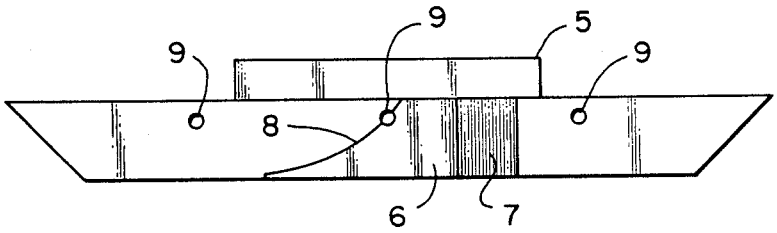
FIG. 3 is a side view of the drag shoe.

FIG. 1 illustrates a typical street sweeper 1. On said sweeper 1 there are a number of rotating brushes. The gutter brush 2 rotates to sweep debris from the side of said sweeper 1 underneath it so said debris can be swept up by said sweeper 1. The debris which is underneath said sweeper 1 is swept forward and up into a hopper by a cylindrical sweeper brush 3. To prevent debris from escaping laterally from said sweeper brush 3, a drag shoe 4 is positioned perpendicular to the axis of said sweeper brush 3. Said drag shoe 4 is fixed laterally so that it remains at the outside end of said cylindrical sweeper brush 3. As the term suggests, said drag shoe 4 drags on the road surface. This dragging action causes severe frictional forces on said drag shoe 4. To make said drag shoe 4 more wear-resistant, it is made of polyurethane. Said polyurethane has a hardness of from about 80 to 90 determined by the Shore A test. The use of said polyurethane allows an increase of the life expectancy by a great factor compared with the drag shoes heretofore in use.

Said drag shoe 4 has basically a trapezoidal shape. Attached to said trapezoidal shape is a vertical fin 5 which is flush with the inside surface of and extends from the top of said drag shoe 4. Said vertical fin 5 further contains debris which is being swept by said cylindrical sweeper brush 3.

Additionally, there is a horizontal platform 6 which extends partly underneath said cylindrical sweeper brush 3 again to aid in the effectiveness of the sweeping operation. Said horizontal platform has an angled leading edge 7 to prevent the entrapment of debris out of the reach of said cylindrical sweeper brush 3. The rear of said horizontal platform 6 has a concave surface 8 which ends flush with said bottom of said drag shoe 4. This arrangement allows the sweeper brush to move debris up said concave surface 8.

Said drag shoe 4 has bolt holes 9 whereby bolts can be used to attach said drag shoe 4 to said sweeper vehicle 1. Additionally, there are spacers 10 on the outside surface of said drag shoe 4 at the bolt holes 9 to allow for the separation of the main body of the drag shoe 4 from a means for attaching said drag shoe 4 to said sweeper vehicle 1.

The above description is meant only as a description of the preferred embodiment and not as the full extent of the invention. In particular, it is noted that the invention applies to a wide variety of street sweeper, and not just to those incorporating brush techniques for debris removal. The full scope of the invention is set out below in the claims.

What is claimed is:

1. A street sweeper drag shoe comprising:

a. an essentially planar piece of an elastomeric material having a top and a bottom, wherein the length dimension thereof is much greater than the height dimension thereof, both dimensions being greater than the thickness thereof, b. attachment means to attach said street sweeper drag shoe to a sweeper vehicle, and c. a horizontal platform extending from the bottom of said drag shoe toward the interior of said sweeper vehicle.

2. The drag shoe of claim 1 wherein said horizontal platform uniformly engages bristles of a cylindrical rotating brush which is attached to said sweeper vehicle.

3. The drag shoe of claim 2 further comprising a horizontal strip, the height dimension thereof being much greater than the thickness dimension thereof, said horizontal strip is attached to said drag shoe and extends vertically above said drag shoe.

4. The drag shoe as in any one of claims 1–3 wherein said elastomeric material is polyurethane.

5. The drag shoe of claim 4 wherein said polyurethane material has a hardness from about 80 to about 90 as determined by the Shore A durometer test.

6. The drag shoe of claim 1 in which said drag shoe incorporates spacers to create a gap between said drag shoe and said means for attaching said drag shoe to said sweeper vehicle.

7. The drag shoe of claim 1 in which said essentially planar piece is essentially trapezoidal in shape with the base of said trapezoid being said top of said drag shoe.

8. A street sweeper drag shoe comprising:

a. an essentially planar piece of polyurethane material having a top and a bottom, wherein the length dimension thereof is much greater than the thickness thereof, wherein said polyurethane material has a Shore A hardness of 80 to 90, and wherein said planar piece of polyurethane is rssentially trapezoidal in shape, wherein the base of said trapezoid is said top of said drag shoe, b. a horizontal strip attached to and extending vertically above said drag shoe, wherein the height dimension of said horizontal strip is much greater than the thickness thereof, c. attachment means to attach said drag shoe to a sweeper vehicle, and d. a horizontal platform extending from said bottom of said drag shoe toward the interior of said sweeper vehicle, wherein said horizontal platform uniformly engages bristles of a cylindrical rotating brush attached to said sweeper vehicle.

* * * * *